United States Patent [19]

Belew

[11] Patent Number: 4,604,038

[45] Date of Patent: Aug. 5, 1986

[54] REMOTELY OPERABLE PERISTALTIC PUMP

[75] Inventor: Robert R. Belew, Huntsville, Ala.

[73] Assignee: The United States of America as represented by the Administrator of the National Aeronautics and Space Administration, Washington, D.C.

[21] Appl. No.: 709,255

[22] Filed: Mar. 8, 1985

[51] Int. Cl.[4] ..... F04B 43/12

[52] U.S. Cl. ..... 417/475

[58] Field of Search ..... 417/477, 475

[56] References Cited

U.S. PATENT DOCUMENTS

| | | | |
|---|---|---|---|
| 922,205 | 5/1909 | Still | 417/475 X |
| 2,696,173 | 12/1954 | Jensen | 417/477 |
| 3,101,674 | 8/1963 | Weiskopf et al. | 417/475 |
| 3,358,609 | 12/1967 | Worth et al. | 417/477 |
| 3,723,023 | 3/1973 | Gelfard | 417/475 |
| 4,333,088 | 6/1982 | Diggins | 417/475 X |

*Primary Examiner*—Richard E. Gluck

*Attorney, Agent, or Firm*—Joseph H. Beumer; John R. Manning; Leon D. Wofford, Jr.

[57] ABSTRACT

A peristaltic pump (A) is disclosed which includes a roller assembly (D) having a plurality of pump rollers (12) carried thereon. As the roller assembly is rotated by a drive gear (66) the pump rollers (12) are driven in reverse rotation by means of a stationary ring gear (70) and pump roller gears (72). An upper pressure shoe plate (B) and a lower pressure shoe plate (C) are positioned above sets of flexible tubing (E) which interlace with each other at a back side (25) of a frame. The tubing (14, 16) is sandwiched between the pressure shoe plates and the pump rollers (12). A highly compact pump is provided having twice as many fluid channel lines as is conventional. The peristaltic pump device may be remotely operated by means of a rotary actuator (100) which rotates a driving hub (86, 88) to move the shoe plates (B and C) by means of eccentrically mounted links (89, 90). The pressure shoe plates may be moved by the rotary actuator to a loaded position in which the fluid lines are pinched by the pump rollers and fluid is pumped to an unloaded position in which the fluid lines are maintained in an undeformed, uncrimped configuration so that no creases or crimps are set into the fluid lines during periods of prolonged nonuse.

20 Claims, 6 Drawing Figures

Fig. 2.
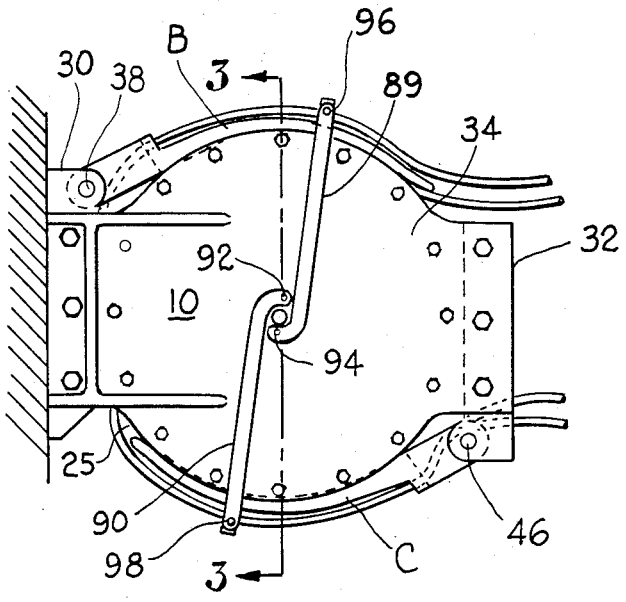
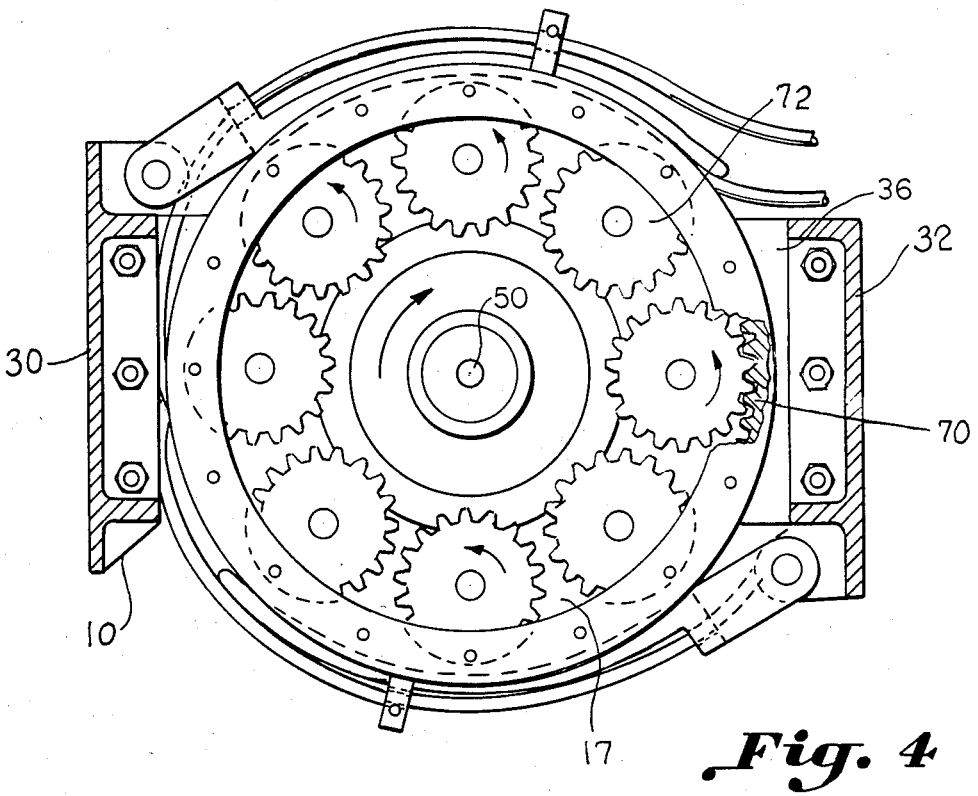
Fig. 4

REMOTELY OPERABLE PERISTALTIC PUMP

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

The invention relates to peristaltic pumps and, more particularly, to a peristaltic pump which may be operated from a remote location. It is desirable in certain applications, for example, in space experiments, for a peristaltic pump to be in a hermetically sealed environment which makes it necessary that the operation of the pump be remotely controlled.

Heretofore, peristaltic pumps have been provided which utilize a plurality of rollers which move in a circular orbit and engage a piece of flexible tubing to force fluid through the tubing in a peristaltic type pumping action such as shown in U.S. Pat. Nos. 3,740,173, 3,737,256 and 2,898,864. The problem occurs, however, that the conventional type peristaltic pump is limited in the number of tube lines which it can accommodate and, also, in the manner in which it may be operated, particularly in a remote manner. Another problem with the conventional peristaltic pump is that in an off condition, at least one of the pump rollers is left in a configuration where it is pinching the flexible tubing. If the pump is left in this condition for a long time, the tubing can be set with a pinch or other irregularity in its diameter. In applications where a high degree of accuracy is required, this pinch which is set in the tubing can affect the accuracy of the amount or volume of fluid, or rate at which the fluid is pumped.

In one particular experiment carried out on the orbiting shuttle vehicle in space, referred to as the recirculating isoelectric focusing operation, it is a requirement that the flows be kept parallel and equal in the separate flow channels.

Accordingly, an important object of the present invention is to provide a compact multichannel peristaltic type pump which can be operated from a remote location.

Still another important object of the present invention is to provide a remotely controlled peristaltic pump which in an unloaded mode leaves the flexible fluid tubes in an undeformed condition so that the fluid lines always remain in a similar configuration with one another without any preset pinches or other deformities.

Still another important object of the present invention is to provide a remotely controlled peristaltic pump which is compact yet incorporates a large number of individual fluid tube channels in a small amount of space.

Still another important object of the present invention is to provide a peristaltic pump having an actuating mechanism which is simple and reliable in its operation for remotely turning the pump off and on in an unloaded and loaded position.

SUMMARY OF THE INVENTION

The above objectives are accomplished according to the present invention by providing a series of individual pump rollers which are arranged in a planetary configuration and are driven in a direction reverse to the rotation of an assembly of the rollers. An upper pressure shoe and a lower pressure shoe are provided which engage a first set of flexible tubing and a second set of flexible tubing. The upper shoe engages the first set of tubing and the lower set engages the second set of tubing. By making the pressure shoes noncontinuous surfaces, the flexible tubing is allowed to cross and interlace behind the shoes. The first set of flexible tubing carried by the upper shoe is laced over the lower shoe, and the second set of tubing which is engaged by the lower shoe is laced over the top of the upper shoe. In this manner, a highly compact multichannel arrangement is provided for the peristaltic pump. By providing a unique off and on mechanism for bringing the upper and lower pressure shoes into engagement with the sets of flexible tubing, all of the tubing can be made to be in a completely pre-state, undeformed condition when the pump is off. In this manner, no preformed pinches or other deformities are made in the tubing when it is off. In the situations where the experimental module is left on the space shuttle for extended lengths of time while awaiting a launch, the tubing is kept in its natural and undeformed configuration so that the pump rates and pump flows through the tubing are identical for each adjacent channel. A tube guide may be utilized to channel the tubing on leaving the upper and lower pressure shoes as needed.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is an end elevation of a compact peristaltic pump constructed according to the present invention with remotely operable pressure plates;

FIG. 4 is a sectional view taken along line 4—4 of FIG. 3;

DESCRIPTION OF A PREFERRED EMBODIMENT

Figure 1:
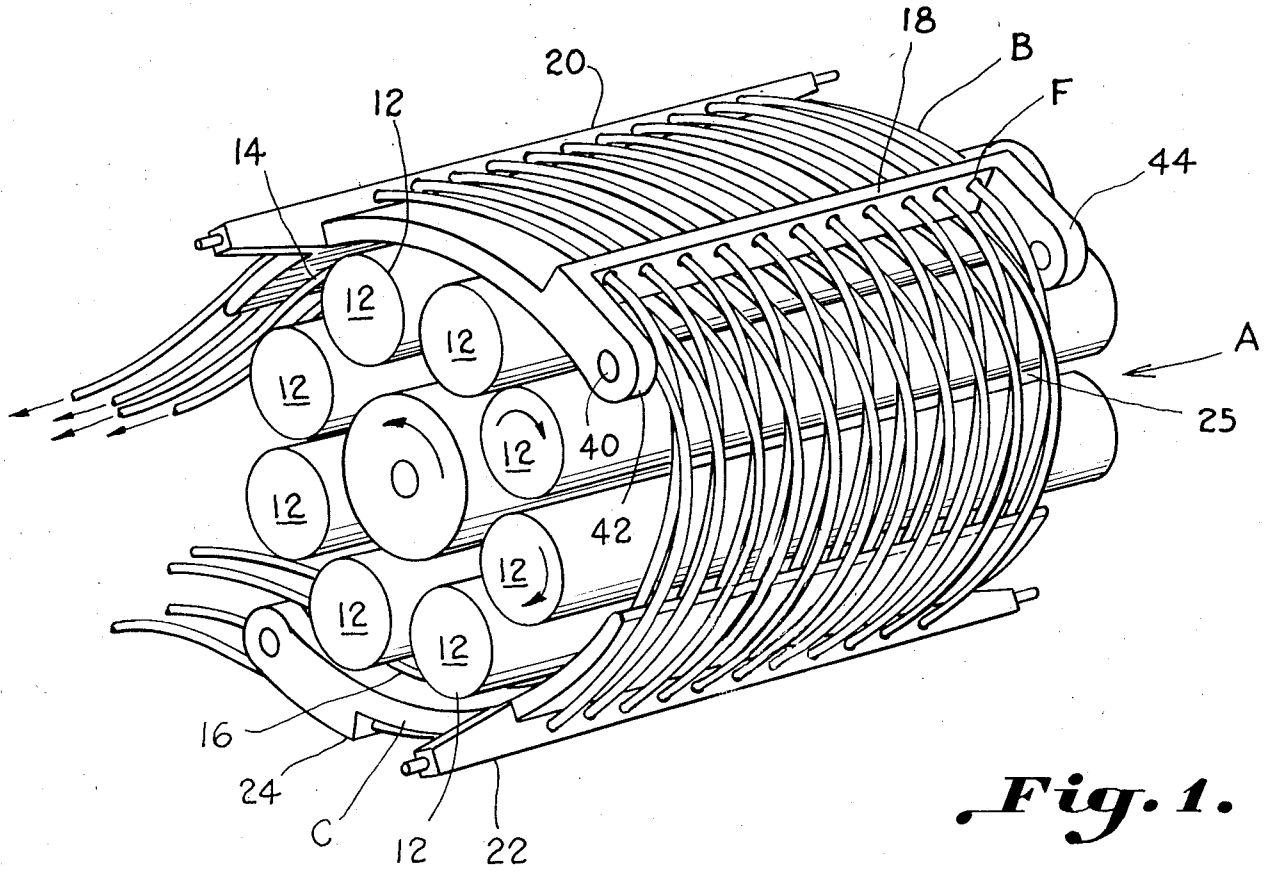
FIG. 1 is a perspective view illustrating a compact peristaltic pump device having multiple parallel flow channels constructed according to the present invention.

Referring now in more detail to the drawings, FIG. 1 is a perspective view illustrating a peristaltic pump device, designated generally as A, constructed in accordance with the present invention which includes an upper pressure shoe plate B and a lower pressure shoe plate C. The pressure shoe plates are arcuate in shape and are mounted for pivotal movement on a frame housing as can best be seen in FIGS. 2 and 4. The pressure shoe plates are positioned relative to a number of pump rollers 12 which are circumferentially spaced about roller assembly D so that flexible tubes 14 are pinched between the rollers to affect a peristaltic pumping action when the pump is operating.

There are a first number of flexible tubes 14 which are mounted between the pump roller 12 and the upper pressure shoe plate B. There are a second number of flexible tubes 16 which are mounted between the pump rollers 12 and the lower pressure shoe plate C. Means for mounting the first and second number of flexible tubes in these positions include a pair of spaced longitudinal shoe stiffening ribs 18 and 20 carried on the upper pressure shoe plate B and a like pair of longitudinal shoe stiffening ribs 22 and 24 which are spaced apart and parallel on the lower pressure shoe plate C. There is a plurality of tube guides F in the form of bores carried by and formed in the stiffening ribs for receiving the flexible tubes 16. It will be noted that there is a space between the upper and lower pressure shoe plates and that the first number of flexible tubes 14 leave their engagement between the pump rollers 12 and upper pressure shoe plate B in this space and interlace with the second number of flexible tubes 16 which are emerging in the space from between the pump rollers 12 and the lower pressure shoe plate C. This enables doubling of the number of channels provided by the hollow flexible tubes for pumping fluid through the peristaltic pump. The flexible tubes 14, 16 of the first and second number of tubes interlace and crisscross in the space between the upper and lower pressure shoe plates at the rear side of the frame. For this purpose, the housing frame is interrupted at 25 at the back side.

Referring now in more detail to the drawings, FIG. 2 shows an end view of the peristaltic pump A with the pressure shoe plates B and C in a loaded pump position in which fluid is pumped. The housing frame 10 is illustrated as including a rear frame member 30, a forward frame member 32, and integral side frame members 34 and 36. The rear frame member 30 can be attached to any suitable supporting structure represented by the shaded area. The side members are made integral by bolts and nuts as well as any other conventional fastening means. The main housing frame which supports the pump is therefore comprised of the rear frame member 30, the forward frame member 32, side frame 34, and side frame 36 as joined together.

As illustrated in FIGS. 1, 2 and 4, the upper pressure shoe plate B is pivotally attached to the rear frame member 30 by means of a pivot pin 38 which extends through an opening 40 formed in two legs 42 and 44 of the pressure shoe plate. In a like manner, the lower pressure shoe plate C is pivotally attached by a pivot pin 46 at the forward frame member 32 at both ends thereof.

Figure 3:
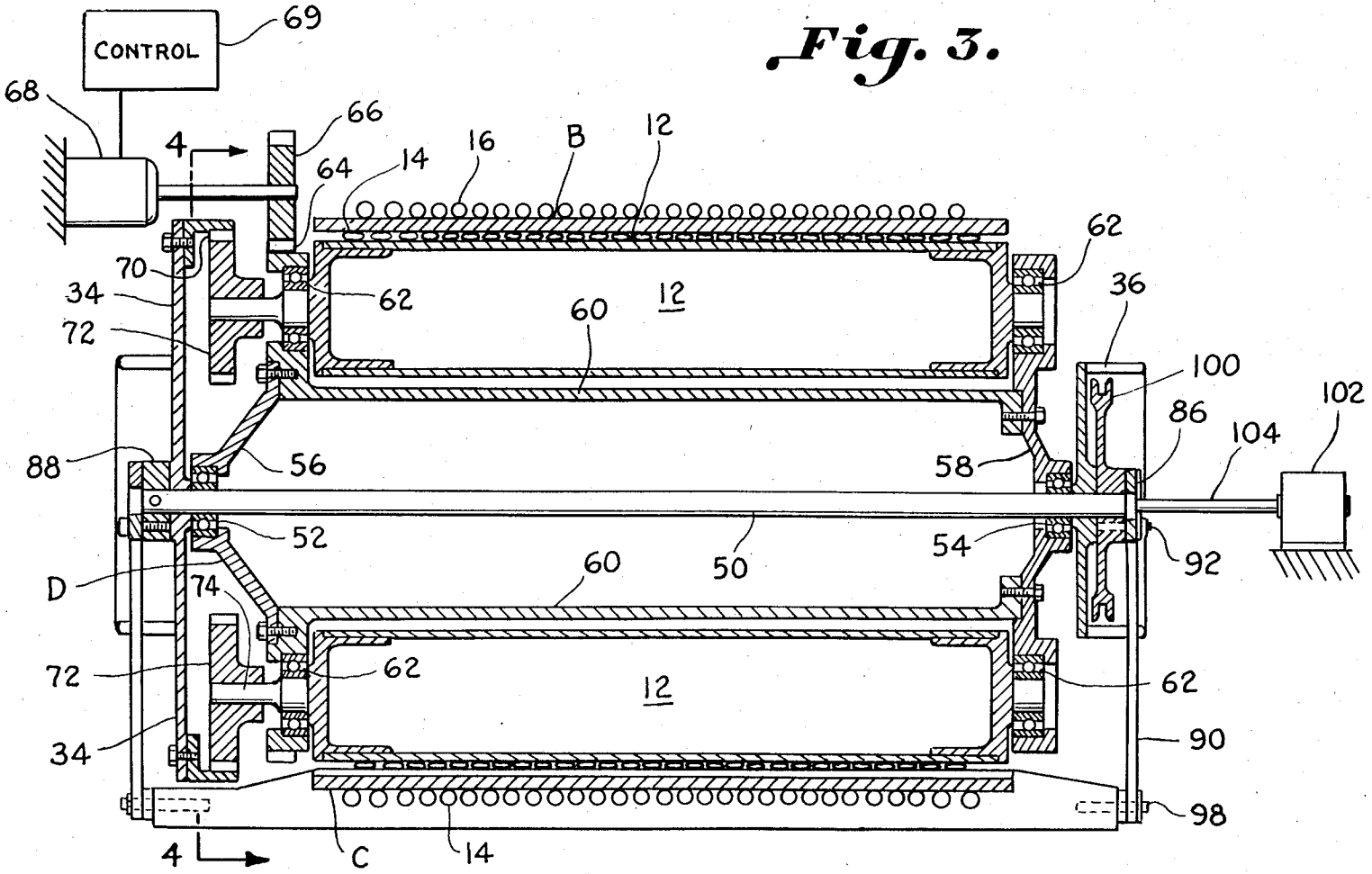
FIG. 3 is a sectional view taken along line 3—3 of FIG. 2.

As can best be seen in FIGS. 3 and 4, there is a central shaft assembly 50 which includes a central shaft that extends through right and left hand main bearings 52 and 54, respectively. The ends of the central shaft 50 extend through the side frame members 34 and 36 for purposes which will be more fully described hereinafter. The pump roller assembly D is rotatably carried on the central shaft assembly 50 by means of the main bearings 52 and 54. There is a first support 56 and a second support 58 for the roller assembly, both of which include the main bearings, and there is a main support 60 connected to the first and second supports. The main roller assembly support 60 carries ball bearings 62 by which the pump rollers 12 are rotatably carried on the roller assembly.

There is an integral drive gear 64 formed on the outer circumference of the support arms 56 and 58 meshing with a drive gear 66 that is driven by a first rotary drive 68 which may be any conventional rotary drive controlled by a conventional control circuit 69. The drive 68 and the drive gear 66 drive the roller assembly D in rotation in the direction indicated by the arrow about central shaft 50 in FIG. 4. There is a stationary ring gear 70 carried by the outer edge of side frame member 34 around the entire circumference and periphery. The stationary ring gear meshes with individual roller drive spur gears 72 affixed to the rollers 12 by means of an intermediate shaft 74 which is received in the roller bearing 62. As the roller assembly D is rotated, the roller drive gears 72 engage the stationary ring gear 70 to cause the rollers 12 to individually rotate in a direction opposite that which the roller assembly D is rotating as illustrated by the arrows in FIG. 4. The stationary ring gear 70 and the pump roller drive gears 72 provide a second rotary drive for rotating the pump rollers 12.

Figure 5:
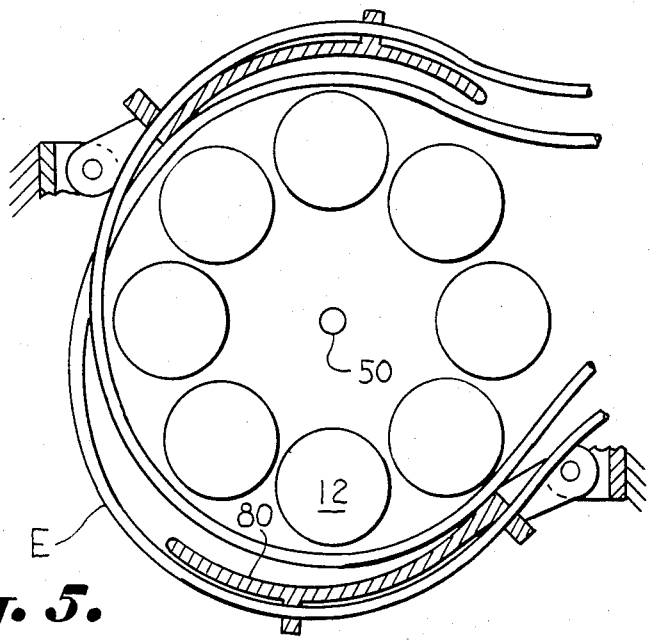
FIG. 5 is a schematic view illustrating a compact peristaltic pump constructed according to the present invention having multiple parallel flow channels and remotely operable pressure plates with the pump being illustrated in an unloaded position.
Figure 6:
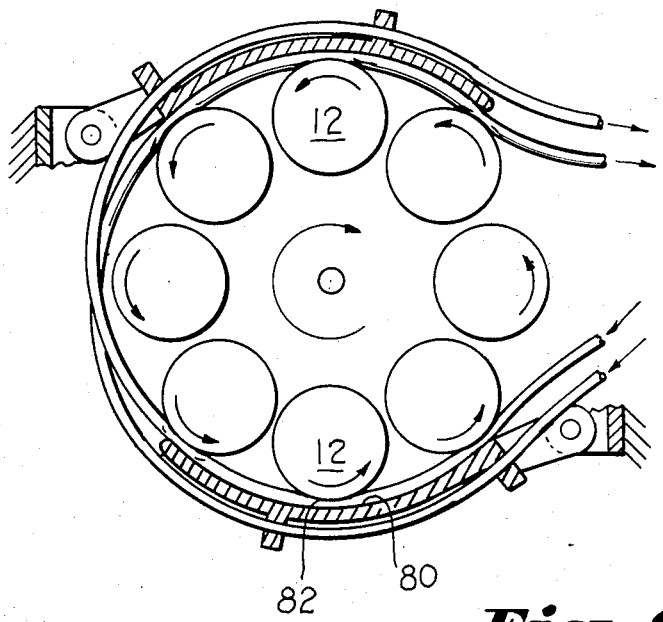
FIG. 6 is a schematic view of the peristaltic pump of FIG. 5 with the pump being shown in a loaded position for pumping.

Referring now to FIGS. 5 and 6, the operation of the peristaltic pump will be described. FIG. 5 illustrates the peristaltic pump in an idle of unloaded position in which no fluid is being pumped. Both the upper pressure shoe plate and the lower pressure shoe plate are out of contact with the flexible tubes 14, 16. The FIGS. 5 and 6 illustrate shematically how two rows of flexible tubes are accommodated by the peristaltic pump according to the invention to double the number of channels and multiply the capacity of the pump in a compact configuration. In the unloaded position of FIG. 5, the pressure plates are rotated away from the roller assembly D to free the tubes from external loading between the rollers and the pressure plates. The roller assembly would normally be at rest in the unloaded position. The pump rollers of FIGS. 5 and 6 are illustrated as circles and the central shaft assembly is illustrated at 50. In the loaded position in which pumping occurs in FIG. 6, the pressure plates are brought into contact with the flexible tubes so that the fluid filled tubes are sufficiently squeezed to seal off the tubes between the revolving rollers and their respective pressure plates to provide a peristaltic pumping action. The pressure plates B and C have a concave, arcuate configuration. The arcuate surface 80 of the pressure shoe plates form a section of a cylinder whose axis is somewhat coincident with the axis of the central shaft assembly 50. The concave surface of the pressure shoe plates is disposed over the rollers and conforms to the curvature of rollers 12 and conforms to the curvature of the roller assembly D at the point of contact 82 of maximum pinching and squeezing by the rollers.

As can best be seen in FIGS. 2 and 3, actuating means for moving the upper and lower pressure shoe plates between their loaded and unloaded positions is provided by a rotary drive hub 86 carried on one end of the central drive shaft, and a rotary drive hub 88 carried on the other end of the central shaft assembly. Linkage means connecting the drive hub to the pressure shoe plates are provided by a pair of control links 89 on both sides of the frame housing connecting the drive hub to the upper pressure shoe plate B. There is a control linkage 90 on each side of the housing frame which connects the driving hub 88 to the lower pressure shoe plate C. Two pins 92 and 94 connect the control links 89 and 90 to the drive hub on each side of the frame housing, and two pins 96 and 98 connect the control links to the pivotable pressure shoe plates on each side of the housing frame. The central shaft assembly 50 incorporates an integral pulley 100 to which a lanyard can be attached as a means to manually position the pressure plates from a remote operator station. As the central shaft assembly 50 is rotated approximately 180 degrees, the pressure plates are moved between the unloaded position and the loaded pumping position. The eccentric connection of control linkage 89,90 provides a means for limiting movement of rotary actuator hubs 86,88 and shaft 50 between the loaded and unloaded positions.

Alternately, a rotary drive in the form of a rotary actuator 102 may be provided having a rotary shaft 104 which is connected directly to the central shaft assembly and axially therewith. The rotary actuator may be electrically operated from a remote location and provided with conventional limit switches to limit rotation of the central shaft assembly 50 between 180 degree positions to move the pressure plates B and C in and out of their loaded and unloaded positions.

Thus, it can be seen that a highly advantageous construction can be had for a remotely operable peristaltic pump wherein the remotely operable pressure plates allow the pump to operate in a hermetically sealed environment. The fluid tubes can be unloaded until pumping is required to prevent any set from occurring in the tubes due to the long-term clamping action between the stationary pump rollers and the pressure plates. Opposing pressure plates allow simultaneous pumping on opposite sides of the pump to effectively double the number of fluid channels for a given diameter pump. A simplified actuating means for moving the pressure plate between the unloaded and loaded position is provided by a rotating central shaft assembly which drives eccentrically pivoted control links to angularly position the pressure plates.

While a preferred embodiment of the invention has been described using specific terms, such description is for illustrative purposes only, and it is to be understood that changes and variations may be made without departing from the spirit or scope of the following claims.

What is claimed is:

1. A compact peristaltic pump device having multiple flow channels comprising:

a housing frame having a rear frame member and a front frame member with integral side frame members spaced apart and carried between said rear and front frame members;

a central shaft assembly carried between said side frame members having a central shaft rotatably carried by said side frame members;

a rotating roller assembly rotatably carried by said central shaft assembly;

a plurality of circumferentially spaced rollers carried about said roller assemblies;

first rotary drive means for rotating said roller assembly about said central shaft;

second rotary drive means for rotating each one of said rollers individually on said roller assembly as said roller assembly is driven about said central shaft;

an upper pressure shoe plate carried by said housing frame generally above said roller assembly;

a lower pressure shoe plate moveably carried by said housing frame generally below said roller assembly in diametrically opposing relation to said upper pressure shoe plate;

means for mounting a first number of flexible tubes in a side by side arrangement between said roller assembly and said upper pressure shoe plate generally along the length of said upper pressure shoe plate to provide multiple parallel flow channels;

means for mounting a second number of flexible tubes between said roller assembly and said lower pressure plate in a side by side arrangement generally along the entire length of said lower pressure shoe plate to provide multiple parallel flow channels;

said mounting means including guide means for interlacing said first and second number of flexible tubes with one another so that said first number of flexible tubes are guided along an outside surface of said lower pressure shoe plate, and said second number of flexible tubes are guided along an outside surface of said upper pressure shoe plate with said first and second number of flexible tubes crossing between each other at said rear frame member of said frame housing.

2. The device of claim 1 including actuating means for moving said upper and lower pressure shoe plates into engagement with said first and second number of flexible tubes to load said tubes for imparting a peristaltic pumping action through said tubes as said roller assembly and pump rollers are rotated; and said actuator means moving said pressure shoe plates to an unloaded position when said device is not operational to unload said flexible tubes until pumping is required preventing any set from occurring in the tubes due to long-term clamping action between said pump rollers and said pressure plates.

3. The actuating means of claim 2 wherein said actuating means is adapted for remote operation from a remote location.

4. The apparatus of claim 2 wherein said actuating means includes:

a drive hub carried by said central shaft;

a plurality of eccentrically pivoted control links eccentrically carried on said drive hub;

said control links being connected to said upper and lower pressure shoe plates to angularly position said pressure shoe plates in said loaded and unloaded positions.

5. The device of claim 4 wherein said drive hub is rotated between said loaded and unloaded positions by a third rotary drive means which may be controlled from a remote location so that said peristaltic pump may be loaded and unloaded remotely.

6. The device of claim 4 wherein said actuating means includes a rotary actuator for rotating said central shaft assembly, and means for limiting said actuating means to limit the movement of said rotary actuator between said loaded and unloaded positions.

7. The device of claim 4 including a pair of said eccentrically pivoted control links carried on opposing sides of said roller assembly, and including a drive hub carried on each end of said central shaft assembly eccentrically connected to said control links on each side of said roller assembly, so that one of said drive hubs is rotatably driven and the other drive hub is driven through said central shaft assembly.

8. The device of claim 1 wherein said mounting means includes tube guides carried adjacent said outside surfaces of said upper and lower pressure shoe plates remote from said flexible tubing pressed between said pump rollers and said pressure shoe plates, and said flexible tubing being received in said tube guides.

9. A device of claim 1 including:

a plurality of longitudinal shoe brace ribs extending along the length of said upper and lower pressure shoe plates; and a plurality of tube guides formed in said shoe brace rib along the length of said rib for receiving said flexible tubes and guiding said tubes in and out of engagement between said pump rollers and pressure shoe plates.

10. The device of claim 9 including a pair of said longitudinal shoe brace ribs extending along the length of said upper and lower pressure shoe plates, said ribs being spaced apart and parallel with each other, and each said rib including a plurality of said tube guides for receiving said flexible tubes.

11. A compact peristaltic pump device having multiple flow channels comprising:

a housing frame having rear frame member and a front frame member with integral side frame members spaced apart and carried between said rear and front frame members;

a central shaft assembly carried between said side frame members having a central shaft rotatably carried by said side frame members;

a rotating roller assembly rotatably carried by said central shaft assembly;

a plurality of circumferentially spaces pump rollers carried about said roller assembly;

first rotary drive means for rotating said roller assembly about said central shaft;

second rotary drive means for rotating each one of said pump rollers individually on said roller assembly as said roller assembly is driven about said central shaft;

a pressure shoe plate moveably carried by said housing frame adjacent said roller assembly;

means for mounting a plurality of flexible tubes in a side by side arrangement between said roller assembly and said pressure shoe plate generally along the length of said pressure shoe plate to provide multiple parallel flow channels;

said mounting means including guide means for routing said plurality of flexible tubes so that said flexible tubes are guided at said rear frame member of said frame housing around said roller assembly to exit said pump at said front frame member;

actuating means for moving said pressure shoe plate to a loaded position in which pressure is placed on said flexible tubes between said pump rollers and said pressure shoe plate to affect a peristaltic pumping action, said actuating means comprising:

a drive hub carried by said central shaft assembly;

linkage means connecting said drive hub with said pressure shoe plate; and means for rotating said drive hub to angularly position said pressure shoe plate; and said actuating means moving said pressure shoe plate to an unloaded position for unloading said flexible tubes when pumping is not required to prevent long-term clamping action between the pump rollers and the pressure plate.

12. The device of claim 11 wherein said actuator means comprises:

a drive hub carried on each end of said central shaft assembly; and one of said drive hubs being driven by said rotary actuator and the other of said drive hubs being driven by said central shaft assembly.

13. The device of claim 12 including a rotary actuator for driving said drive hub and limit means for limiting said rotary actuator and the rotation of said drive hub between said loaded and unloaded pump positions.

14. The device of claim 11 including a rotary actuator for driving said drive hub and limit means for limiting said rotary actuator and the rotation of said drive hub between said loaded and unloaded pump positions.

15. A compact peristaltic pump device having multiple flow channels comprising;

a housing frame having a rear frame member and a front frame member with integral side frame members spaced apart and carried between said rear and front frame members;

a central shaft assembly carried between said side frame members having a central shaft rotatably carried by said side frame members;

a rotating roller assembly rotatably carried by said central shaft assembly;

a plurality of circumferentially spaced rollers carried about said roller assemblies;

first rotary drive means for rotating said roller assembly about said central shaft;

second rotary drive means for rotating each one of said rollers individually on said roller assembly as said roller assembly is driven about said central shaft;

an upper pressure shoe plate carried by said housing frame generally above said roller assembly;

a lower pressure shoe plate moveably carried by said housing frame generally below said roller assembly in diametrically opposing relation to said upper pressure shoe plate;

means for mounting a first number of flexible tubes in a side by side arrangement between said roller assembly and said upper pressure shoe plates generally along the length of said upper pressure shoe plate to provide multiple parallel flow channels;

means for mounting a second number of flexible tubes between said roller assembly and said lower pressure plate in a side by side arrangement generally along the entire length of said lower pressure shoe plate to provide multiple parallel flow channels;

said mounting means including guide means for interlacing said first and second number of flexible tubes with one another so that said first number of flexible tubes are guided along an outside surface of said lower pressure shoe plate, and said second number of flexible tubes are guided along an outside surface of said upper pressure shoe plate with said first and second number of flexible tubes crossing between each other at said rear frame member of said frame housing;

actuating means for moving said pressure shoe plates to a loaded position in which pressure is placed on said flexible tubes between said pump rollers and said pressure shoe plates to affect a peristaltic pumping action; and said actuating means moving said pressure shoe plates to an unloaded position for unloading said flexible tubes when pumping is not required to prevent any set from occurring in the flexible tubes due to the long-term clamping action between the pump rollers and the pressure plate.

16. The device of claim 15 wherein said mounting means for mounting said flexible tubes includes a longitudinal shoe stiffening rib extending along the length of said pressure shoe plates, and a plurality of tube guides carried by said stiffening rib for guiding said tubes along the outside surface of said pressure shoe plate.

17. A peristaltic pump comprising:

a plurality of curved pressure shoe plates arranged in a cylindrical configuration about a central axis and spaced from each other;

a distinct set of flexible tubes for each said pressure shoe plates, at least one flexible tube in a set, and each said set arranged across the face of its respective shoe plate;

a progressive squeezing means rotating about said central axis for moving progressively along the face of said pressure shoe plates for simultaneous peristaltic pumping of all sets of flexible tubes;

an actuating means for movement of said plurality of pressure shoe plates from an unloaded position in which said sets of flexible tubes are not pinched to a loaded position in which said sets of flexible tubes are pinched for peristaltic pumping; and said rotating assembly having a central shaft at said central axis;

a drive hub carried by said central shaft;

a plurality of eccentrically pivoted control links eccentrically carried on said drive hub;

said control links being connected to said spaced pressure shoe plates to angularly position them between said loaded and unloaded positions.

18. A peristaltic pump according to claim 17 further comprising:

said progressive squeezing means being a rotating assembly with a plurality of spaced individual drive rollers for contacting said sets of flexible tubes.

19. A peristaltic pump according to claim 18 further comprising:

a first rotary drive means for rotating said rotating assembly in one direction; and a second rotary drive means for rotating each of said plurality of individual drive rollers in an opposite direction.

20. A peristaltic pump according to claim 19, further comprising:

said actuating means including a feature adapted for actuating from a remote location.

* * * * *